United States Patent [19]

Towsend

[11] 4,374,460

[45] Feb. 22, 1983

[54] ANTI-STATIC SHOE SOLE

[76] Inventor: Marvin S. Towsend, 1365 Potomac Hts. Dr., Fort Washington, Md. 20744

[21] Appl. No.: 291,922

[22] Filed: Aug. 11, 1981

[51] Int. Cl.[3] ..... A43B 13/12; A43B 13/22; A43D 9/00

[52] U.S. Cl. ..... 36/30 R; 36/98; 12/146 B

[58] Field of Search ..... 36/128, 83, 59 R, 59 C, 36/98, 30 R; 12/146 B, 142 R

[56] References Cited

U.S. PATENT DOCUMENTS 4,007,549 2/1977 Moore ..... 36/59 C

*Primary Examiner*—Patrick D. Lawson

[57] ABSTRACT

The object of the invention is to provide a shoe sole which prevents the build up of static electricity to the degree that a shock occurs when a shoe is worn while walking across a floor covering such as a carpet. Electrically conductive elements in the shoe sole are unnecessary. Alteration of the carpet is unnecessary. A build up of static electric charge between the shoe sole and the floor covering is prevented when the sole has a bottom portion made from substantially the same material as the surface of the floor covering.

Shoe (1) having sole (2) is used for walking across floor covering (4). The bottom portion (3) of sole (2) is made from substantially the same material as floor covering surface (5). The bottom portion (3) may be a coating which may be brushed or sprayed on. Bottom portion (3) may also be a film material which adheres to the remainder of sole (2) by means of a pressure sensitive adhesive. A piece of floor covering (4) may be fixed to the sole (2) by means of an adhesive on the base (6) of the floor covering (4). In this way, the floor covering surface (5*a*) of the piece serves and the bottom portion (3) of the sole (2).

For use on a nylon floor covering, a shoe sole may be coated with a nylon film obtained by using a nylon latex dispersion.

9 Claims, 2 Drawing Figures

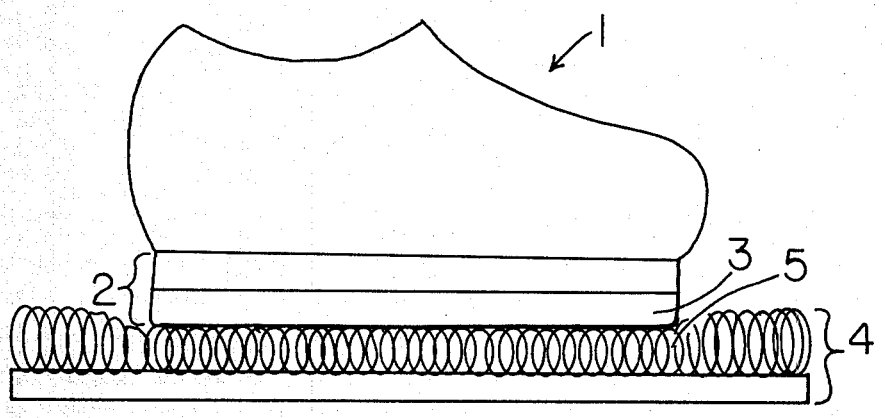
FIG. 1
FIG. 2
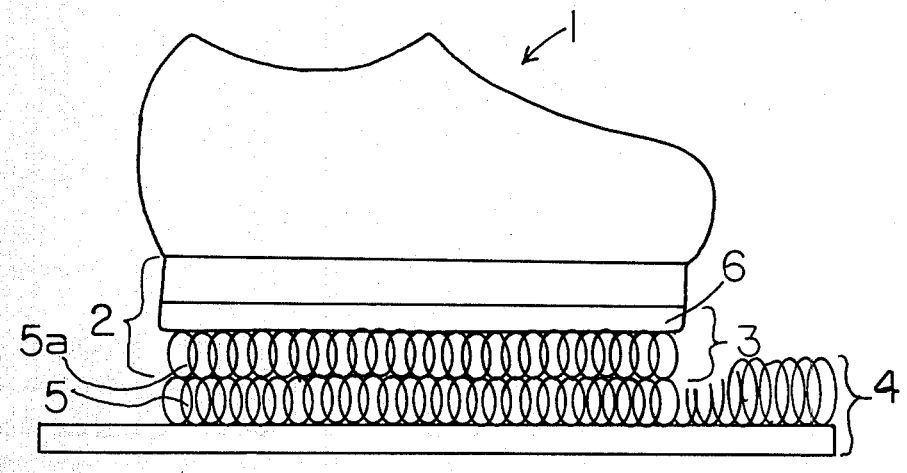

ANTI-STATIC SHOE SOLE

TECHNICAL FIELD

The invention relates to articles designed to prevent static electricity from accumulating and shocking a person walking across a floor covering such as a rug or carpet. Specifically, the invention relates to a shoe sole having anti-static properties.

BACKGROUND ART

Static electricity problems with floor coverings such as carpets and rugs are well known. Most people have been shocked upon touching a door knob or other metal object after walking across a carpet.

Various attempts have been made to construct footwear designed to prevent static discharges. One type of footwear employs electrically conductive elements within the shoe structure. An example is in U.S. Pat. No. 3,993,932.

A second type of footwear is a flexible, disposable, and conductive shoe covering as exemplified in U.S. Pat. No. 3,869,647. Here, the entire shoe is convered by the conductive covering.

A third type of footwear includes a grounding strap which contacts both the skin of the person and the floor. This is exemplified in U.S. Pat. No. 3,800,446.

The three types of footwear disclosed above have a common characteristic; namely, they use electrically conductive materials to drain away electric charge as it is generated to prevent a build up sufficient to cause a shock. None of the patents disclose footwear designed to prevent a static charge from being generated.

The root cause of the static electric build up is the frictional contact between the disparate materials making up the person's shoe sole and the floor covering surface which the shoe sole contacts.

Materials have been listed as to their electrostatic properties resulting from frictional contact. This list is called the Triboelectric Series.

Materials important in carpet fibers and shoe soles are listed in their approximate order of electric charge generating potential in the Triboelectric Series in Table I.

TABLE I

Triboelectric Series

Positive End
- Wool
- Nylon
- Polyester
- Acrylic and Modacrylic
- Polyvinyl Chloride
- Shoe Leather
- Neolite
- Polypropylene Negative End Nylon is by far the most important carpet fiber accounting for well over half of carpet surface fiber used.

Actual static charge developed by frictional contact between two disparate materials depends on a number of factors, including: differential in Triboelectric Series; pressure when undergoing contact; speed of contact; duration of contact; electrical conductivity of the materials; and relative humidity in the room.

A variety of methods have been employed to reduce discomforting static discharge caused by walking on a carpet. Many of these methods have been directed toward lessening one or more of the factors mentioned above.

Maintenance of high relative humidity may be difficult particularly in heated rooms during winter.

Blends of carpet fibers to produce a composite carpet surface having triboelectric characteristics close to common shoe sole materials such as leather and Neolite have been disclosed. An example is found in U.S. Pat. No. 3,371,247.

Addition of internal and external electrostatic agents to the carpet fibers has been disclosed. An internal chemical anti-static agent is disclosed in U.S. Pat. No. 3,510,386. An external chemical anti-static agent is disclosed in U.S. Pat. No. 3,888,678.

Carpet fibers having increased conductivity are disclosed in U.S. Pat. No. 3,582,445. Carpets incorporating conductive metal fibers are disclosed in Modern Textile Magazine, June 1967, pages 53–56.

Of the methods described above, most share one characteristic; namely, the carpet fiber is altered to reduce static shock. None of these methods are directed toward a shoe sole designed specifically to prevent generation of static electricity.

It should be understood that not all disparities between triboelectric characteristics of carpet and shoe sole materials are sufficient to cause shocking static build ups. When less than 3,000 volts is built up, no shock is felt by an average person. In the 3,000–4,000 volt range, a shock may be noticeable but not severe. At greater than 4,000 volts, shock is noticeable and progressively more severe.

In the American Dyestuff Reporter, June 1975, page 18, it is reported that nylon is the major carpet fiber used in the United States, and it seems to be the most prone to exhibiting bad static properties. The nature of shoe sole materials which are used for walking on carpets is an important factor in the build up of static charge. The standard Neolite and leather soles are fairly close in the triboelectric series to acrylic and polypropylene fibers, and the differential between nylon and the standard soles is large enough to produce upwards of 10,000 volt static charge build up.

Since well over half of surface carpet fibers are made from nylon, it would be particularly desirable if a technological advance were made directed toward reducing static shock problems due to nylon carpets.

DISCLOSURE OF INVENTION

In view of the deficiencies and inadequacies described above, it is an object of the invention to provide an anti-static shoe sole which prevents a shocking static charge from being generated between the shoe sole and a floor covering.

Another object of the invention is to provide an anti-static shoe sole which prevents a shocking static charge from being generated between the shoe sole and a floor covering without modification or treatment of the floor covering itself.

Still another object of the invention is to provide an anti-static shoe sole specially treated or fabricated to prevent a shocking static build up from being generated between the shoe sole and a nylon floor covering.

To achieve the foregoing and other objects and in accordance with the purpose of the present invention as embodied and broadly described herein, the anti-static shoe sole of the invention has a bottom portion made from essentially the same material as the surface of the floor covering, thereby preventing the build up of static electricity between the sole and the floor covering when the sole is used for walking across the floor covering.

In a preferred embodiment of the invention, the bottom portion of the anti-static shoe sole is a coating which may be applied by a variety of methods including brushing and spraying on.

The majority of surface fibers used for floor coverings such as rugs and carpets in the United States is made from nylon. For use on nylon carpets, the bottom portion of the shoe sole of the invention is made from nylon. Nylon may be applied to the bottom of a shoe sole by means of a coating of nylon in a liquid carrier which dries to leave a film of nylon. Or nylon may be applied in the form of a solid film having a pressure sensitive adhesive coating.

In another embodiment of the invention, the bottom portion of the anti-static shoe sole may be made from a piece of the floor covering itself. Alternatively, the bottom portion may be made from the stock material used for making the floor covering surface fibers.

In a further aspect of the present invention, in accordance with its objects and purposes, a method of making an anti-static shoe sole having triboelectric properties essentially matched with the triboelectric properties of the surface of a floor covering may comprise the steps of: taking a quantity of floor covering surface material; and making the bottom portion of a shoe sole from the floor covering surface material.

In yet another aspect of the present invention, a method is disclosed for treating a shoe sole for use on a nylon floor covering. The steps for treating the shoe sole are: coating the shoe sole bottom with nylon in a liquid carrier; and allowing the liquid to evaporate forming a nylon film on the shoe bottom thereby imparting anti-static properties to the shoe sole bottom for use on the nylon floor covering. Nylon for the coating may be in the form of a latex emulsion or in the form of nylon dissolved in an organic solvent.

By employing the anti-static shoe sole of the invention, certain advantages are realized. A build up of shocking static electricity between the shoe sole and the carpet is prevented from occurring. Treatment of the carpet is not required since the anti-static nature of the shoe sole is the reason why there is no substantial static build up. When the surface of the floor covering is nylon, the anti-static shoe sole has a bottom portion of nylon; thus the common problem of static shock associated with nylon carpets is alleviated.

BRIEF DESCRIPTION OF DRAWINGS

The accompanying drawings which are incorporated in and form a part of the specification illustrate several embodiments of the present invention and, together with the description, serve to explain the principles of the invention. In the drawings:

FIG. 1 is a side view of one embodiment of the invention contacting a floor covering surface;

FIG. 2 is a side view of a second embodiment of the invention.

BEST MODE FOR CARRYING OUT THE INVENTION

With reference to FIG. 1 in the drawings, shoe 1 has sole 2 which contacts floor covering 4 when someone walks across the floor covering 4. Floor covering 4 may be a rug, carpet, or the like. Sole 2 has bottom portion 3 which directly contacts floor covering surface 5 of the floor covering 4.

According to the invention, bottom portion 3 is made from substantially the same material as the floor covering surface 5. Thereby, a build up of static electric charge between bottom portion 3 and floor covering surface 5 is prevented so that a person wearing a shoe 1 having a sole 2 according to the invention will not experience a static electric shock after walking across the floor covering 4.

Bottom portion 3 may be a coating. The coating may be brushed on or sprayed on or applied by a variety of other well known methods.

Bottom portion 3 may also be part of a unified sole 2 which is made from substantially the same material as the floor covering surface 5. Sole 2 may be made from the same stock material that is used for the fibers in floor covering surface 5.

In FIG. 2, another embodiment of the invention is disclosed in which bottom portion 3 of sole 2 is comprised of a piece of floor covering 5 whose base 6 is adhesively attached to sole 2. With this embodiment of the invention, fiber surface 5*a* which projects from base 6 is in contact with floor covering surface 5 of floor covering 4. Fiber surface 5*a* and floor covering surface 5 are, of course, made from the same material.

Although the principles set forth below are specifically described with respect to nylon, it is understood that these principles apply equally to other materials from which floor covering surface 5 is made. Nylon is by far the most popular material in the United States for making floor covering surfaces 5 in carpets. Nylon is a generic term for high molecular weight linear polyamides capable of being formed and drawn to high tenacity fibers. A wide variety of specific nylon polymers are known which are suitable for coating compositions and tough, flexible film formation.

It should be understood that the triboelectric properties of the various nylons are so close to one another that a shocking static charge build up will not occur when one form of nylon is rubbed against another form of nylon. One form of nylon is substantially the same as another form of nylon with respect to triboelectric properties. A disparity in triboelectric properties between one form of nylon as the bottom portion 3 and another form of nylon as the floor covering surface 5 is insignificant with regard to the possibility of a shocking static charge to be built up. Thus, with regard to triboelectric properties, one form of nylon is substantially the same as another form of nylon.

The principle of substantial sameness of one form of nylon as another form of nylon, with regard to triboelectric properties relating to static electric charge build up sufficient to cause a shock, extends to other carpet fiber materials. That is, one form of carpet fiber material such as wool, polyester, acrylic, modacrylic, and polypropylene in the form of a coating on the bottom portion 3 of a shoe sole 2 is substantially the same as another form of the same carpet fiber material in the floor covering surface 5 of a carpet with regard to the prevention of a shocking static charge build up.

Nylon coatings are of particular interest for anti-static shoe soles of the invention. Nylon latex dispersions suitable for coating leather with a nylon film are disclosed in the following U.S. patents which are incorporated herein by reference: U.S. Pat. Nos. 2,342,387 of Catlin; 2,405,965 of Leekley; and 2,951,054 of Hess.

Nylon is soluble in numerous organic solvents including phenol and cresols and mixed solvents such as alcohol-chlorohydrocarbon mixtures exemplified by ethanol-chloroform and methanol-methylene chloride. Additional nylon solvents are disclosed in the *Encyclopedia of Polymer Science and Technology,* Vol. 10, 1969, pp. 483–597; and in *Synthetic Hetero-Chain Polyamides* by Korshak and Frunze, 1964, pp. 315–325.

The following is an example of a nylon coating for a leather sole for use on a nylon carpet.

EXAMPLE

The floor covering surface is comprised of a nylon called Cumuloft manufactured by Monsanto Co.

A shoe having a leather sole is coated with a nylon latex dispersion as described in Example II of U.S. Pat. No. 2,342,387 of Catlin, incorporated herein by reference. After the water dries off of the coating, the leather sole of the shoe is coated with a thin film of nylon.

The film of nylon on the bottom of the leather sole is of substantially the same material as the nylon in the carpet surface. Thus, a shocking build up of static electric charge is prevented between the nylon coated sole and the nylon carpet when the shoe is used for walking across the carpet.

In view of the foregoing, an anti-static shoe sole and method of making said sole has been described. When the bottom portion of a shoe sole is made from substantially the same material as the surface of the floor covering, the build up of a shocking static electric charge between the shoe sole and the floor covering is prevented when the shoe is used for walking across the floor covering. The bottom portion of the shoe sole is treated whereas the floor covering itself is unaltered. It is unnecessary for the shoe to have electrically conductive elements to drain away excessive charge because an excessive static build up is prevented by the anti-static shoe sole of the invention.

The descriptions of the embodiments set forth above have been presented for purposed of illustration and description. They are not intended to be exhaustive or to limit the invention to the precise forms disclosed. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

Shoe 1 may be of a variety of types including a slipper designed primarily for indoor wear, a shoe designed for both indoor and outdoor wear, and a shoe or boot designed primarily for outdoor wear.

I claim:

1. An anti-static shoe sole for use on the surface of a floor covering, said sole having a bottom portion having a coating made from substantially the same material as the surface of the floor covering, thereby preventing the build up of static electric charges between said sole and the floor covering when said sole with said coating is used on the surface of the floor covering.

2. An anti-static shoe sole as described in claim 1 wherein said coating is brushed on.

3. An anti-static shoe sole as described in claim 1 wherein said coating is sprayed on.

4. An anti-static shoe sole as described in claim 1 wherein said bottom portion coating is made from a nylon for use on a nylon surface floor covering.

5. An anti-static shoe sole as described in claim 4 wherein said nylon bottom portion coating is an adhesive coated nylon film.

6. An anti-static shoe sole as described in claim 1 wherein said bottom portion coating is made from floor covering surface stock material.

7. A method of treating a shoe sole for use on a nylon floor covering, comprising the steps of:

coating the shoe sole bottom with a nylon in a liquid carrier;

allowing the liquid to evaporate forming a nylon film on the shoe sole bottom , thereby imparting anti-static properties to the shoe sole bottom for use on the nylon floor covering.

8. A method for treating a shoe sole as described in claim 7 wherein nylon is in the form of a latex dispersion.

9. A method for treating a shoe sole as described in claim 7 wherein nylon is in the form of nylon dissolved in an organic solvent.

* * * * *